US007244466B2

(12) United States Patent
Van Steenkiste

(10) Patent No.: US 7,244,466 B2
(45) Date of Patent: Jul. 17, 2007

(54) KINETIC SPRAY NOZZLE DESIGN FOR SMALL SPOT COATINGS AND NARROW WIDTH STRUCTURES

(75) Inventor: Thomas Hubert Van Steenkiste, Ray, MI (US)

(73) Assignee: Delphi Technologies, Inc., Troy, MI (US)

( * ) Notice: Subject to any disclaimer, the term of this patent is extended or adjusted under 35 U.S.C. 154(b) by 525 days.

(21) Appl. No.: 10/808,246

(22) Filed: Mar. 24, 2004

(65) Prior Publication Data

US 2005/0211799 A1 Sep. 29, 2005

(51) Int. Cl.
*B05D 1/02* (2006.01)

(52) U.S. Cl. ..... 427/180; 427/191; 427/199; 427/422; 427/427; 427/427.4

(58) Field of Classification Search ..... 427/180, 427/191, 199, 422, 427, 427.4
See application file for complete search history.

(56) References Cited

U.S. PATENT DOCUMENTS

2003/0190414 A1* 10/2003 Van Steenkiste ..... 427/201
2004/0166247 A1* 8/2004 Heinrich et al. ..... 427/446

FOREIGN PATENT DOCUMENTS

WO 03/041868 A * 5/2003

* cited by examiner

*Primary Examiner*—Fred J. Parker
(74) *Attorney, Agent, or Firm*—Scott A. McBain

(57) ABSTRACT

An improved nozzle for use in kinetic spray systems is disclosed. The nozzle includes a supersonic portion comprising a tubular section and a flow regulator. A portion of the flow regulator is received in the tubular portion. The flow regulator includes a biconical flow concentrator that allows one to create very small dimension coatings on substrates. Using the present nozzle enables one to create spot coatings and very narrow width line coatings that find use in electrical components.

35 Claims, 6 Drawing Sheets

KINETIC SPRAY NOZZLE DESIGN FOR SMALL SPOT COATINGS AND NARROW WIDTH STRUCTURES

TECHNICAL FIELD

The present invention is directed to a method for producing a coating using a kinetic spray system and an improved nozzle for use in the same. The improved nozzle permits one to spray a much smaller coating than previously possible. This improvement enables small spot coatings on narrow width line coatings.

INCORPORATION BY REFERENCE

U.S. Pat. No. 6,139,913, "Kinetic Spray Coating Method and Apparatus," and U.S. Pat. No. 6,283,386 "Kinetic Spray Coating Apparatus" are incorporated by reference herein.

BACKGROUND OF THE INVENTION

A new technique for producing coatings on a wide variety of substrate surfaces by kinetic spray, or cold gas dynamic spray, was recently reported in a series of articles by T. H. Van Steenkiste et al., entitled "Kinetic Spray Coatings," published in Surface and Coatings Technology, vol. 111, pages 62-71, Jan. 10, 1999. 386 and in "Aluminum coatings via kinetic spray with relatively large powder particles" published in Surface and Coatings Technology 154, pages 237-252, 2002. The articles discussed producing continuous layer coatings having low porosity, high adhesion, low oxide content and low thermal stress. The articles describes coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air, nitrogen, or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle and the substrate. It is believed that when the particles and the substrate are both metals then the initial particles to adhere to the substrate have broken the oxide shell on the substrate material permitting subsequent metal to metal bond formation between plastically deformed particles and the substrate. Once an initial layer of particles has been formed on a substrate subsequent particles bind not only to the voids between previous particles bound to the substrate but also engage in particle to particle bonds. The bonding process is not due to melting of the particles in the air stream because the temperature of the particles is always below their melting temperature, even when the temperature of the air stream is well above their melting temperature.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic de Laval type nozzle.

The Van Steenkiste article reported on work conducted by the National Center for Manufacturing Sciences (NCMS) to improve on the earlier Alkimov process and apparatus. Van Steenkiste et al. demonstrated that Alkimov's apparatus and process could be modified to produce kinetic spray coatings using particle sizes of greater than 50 microns and up to about 106 microns.

This modified process and apparatus for producing such larger particle size kinetic spray continuous layer coatings are disclosed in U.S. Pat. Nos. 6,139,913, and 6,283,386. The process and apparatus provide for heating a high pressure air flow up to about 650° C. and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to bond the particles to the surface of the substrate. The temperatures and pressures used are sufficiently lower than that necessary to cause particle melting or thermal softening of the selected particle. Therefore, no phase transition occurs in the particles prior to or during bonding. It has been found that each type of particle material has a threshold critical velocity that must be exceeded before the material begins to adhere to the substrate. The disclosed method did not disclose the use of particles in excess of 106 microns.

One difficulty associated with all of these prior art kinetic spray systems is that the particle stream exiting the nozzle rapidly expands so it has not been possible to form small discrete spots or narrow lines of coatings. Instead, the smallest spot coatings are approximately 2 millimeters by 10 millimeters. To achieve finer coatings it has been necessary to use masks. The use of masks is inconvenient and not always satisfactory. Thus, it is desirable to provide a method and apparatus to permit kinetic spraying of discrete small volume areas. Such applied coatings could be used. for example, for electrical contacts, wear points, insulating points in circuit boards and to trace circuits onto circuit boards.

SUMMARY OF THE INVENTION

In one embodiment, the present invention is a method for applying a coating by a kinetic spray method comprising the steps of: providing a powder of particles to be sprayed; providing a supersonic nozzle comprising an outer tubular section with an inner wall and a flow regulator with the flow regulator received inside the inner wall and a flow gap defined between the inner wall and the flow regulator; providing a heated main gas and entraining the particles in the main gas; directing the entrained particles through the gap thereby accelerating the particles and directing the accelerated particles toward a substrate positioned opposite the nozzle; and adhering the accelerated particles to the substrate to form a coating on the substrate.

In another embodiment, the present invention is a method of applying a coating by a kinetic spray method comprising the steps of: providing a powder of particles to be sprayed; providing a supersonic nozzle comprising an outer tubular section with an inner wall and a flow regulator with the flow regulator received inside the inner wall and a flow gap defined between the inner wall and the flow regulator; providing a heated main gas and passing the main gas through the gap; entraining the particles in the main gas after it passes through the gap thereby accelerating the particles and directing the accelerated particles toward a substrate positioned opposite the nozzle; and adhering the accelerated particles to the substrate to form a coating on the substrate.

DESCRIPTION OF A PREFERRED EMBODIMENT

Figure 1:
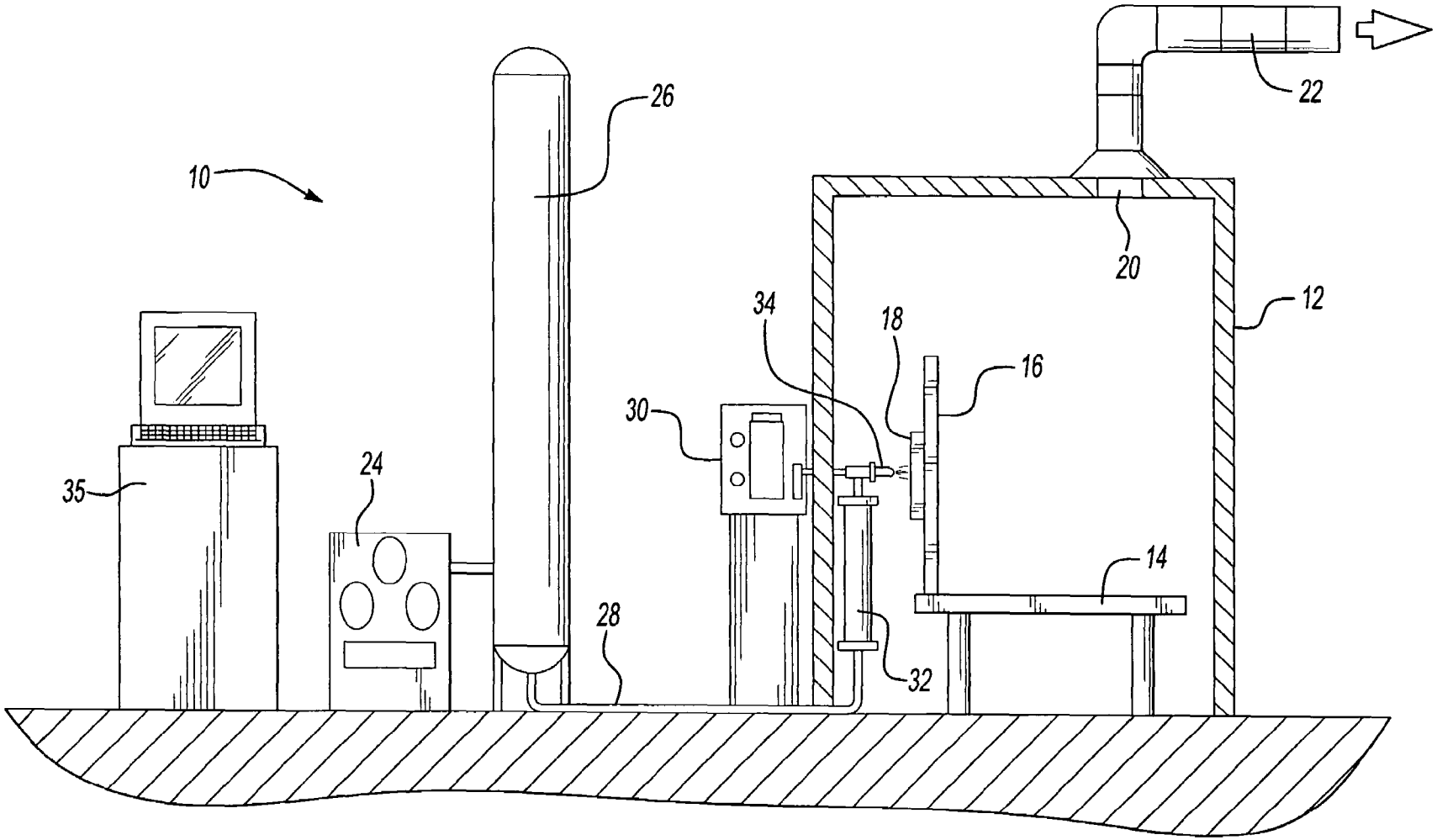
FIG. 1 is a generally schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes a gas compressor 24 capable of supplying gas pressure up to 3.4 MPa (500 psi) to a high pressure gas ballast tank 26. The gas ballast tank 26 is connected through a line 28 to both a high pressure powder feeder 30 and a separate gas heater 32. The gas heater 32 supplies high pressure heated gas, the main gas described below, to a kinetic spray nozzle 34. The powder feeder 30 mixes particles of a spray powder with unheated high pressure gas and supplies the mixture to a supplemental inlet line 48 of the nozzle 34. A computer control 35 operates to control both the pressure of gas supplied to the gas heater 32 and the temperature of the heated main gas exiting the gas heater 32. The gas can comprise air, helium, nitrogen, neon, argon, or mixtures thereof.

Figure 2:
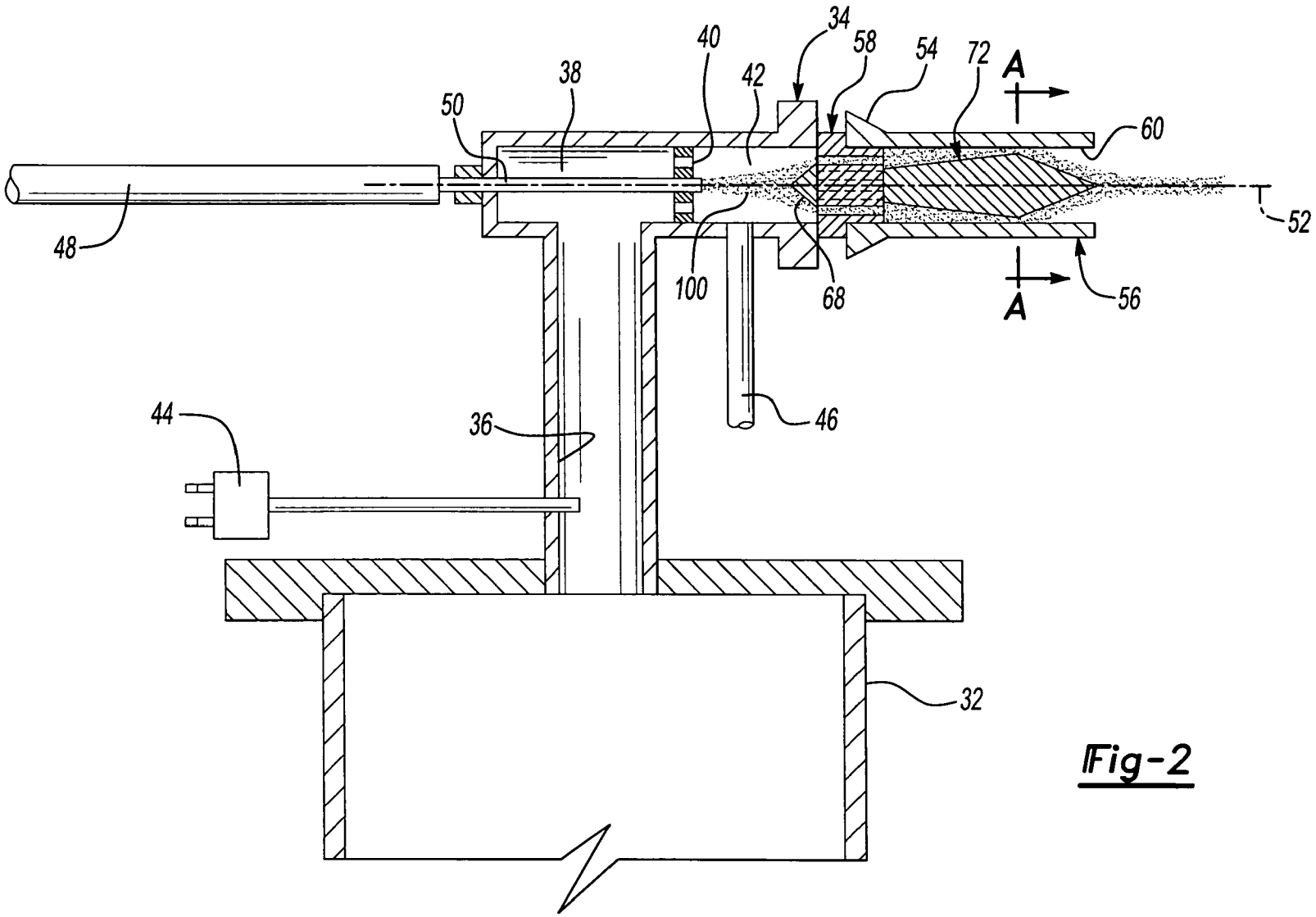
FIG. 2 is an enlarged cross-sectional view of one embodiment of a kinetic spray nozzle designed in accordance with the present invention and used in the system.

FIG. 2 is a cross-sectional view of one embodiment of a nozzle 34 and its connections to the gas heater 32 and the supplemental inlet line 48. A main gas passage 36 connects the gas heater 32 to the nozzle 34. Passage 36 connects with a premix chamber 38 which directs the gas through a flow straightener 40 and into a mixing chamber 42. Temperature and pressure of the heated main gas are monitored by a gas inlet temperature thermocouple 44 in the passage 36 and a pressure sensor 46 connected to the mixing chamber 42.

The mixture of unheated high pressure gas and coating powder is fed through the supplemental inlet line 48 to a powder injector tube 50 comprising a straight pipe having a predetermined inner diameter. The tube 50 has a central axis 52 which is preferentially the same as the axis of the premix chamber 38. The tube 50 extends through the premix chamber 38 and the flow straightener 40 into the mixing chamber 42. Particles 100 exit the tube 50 and are entrained in the main gas flow in the mixing chamber 42.

Figure 3:
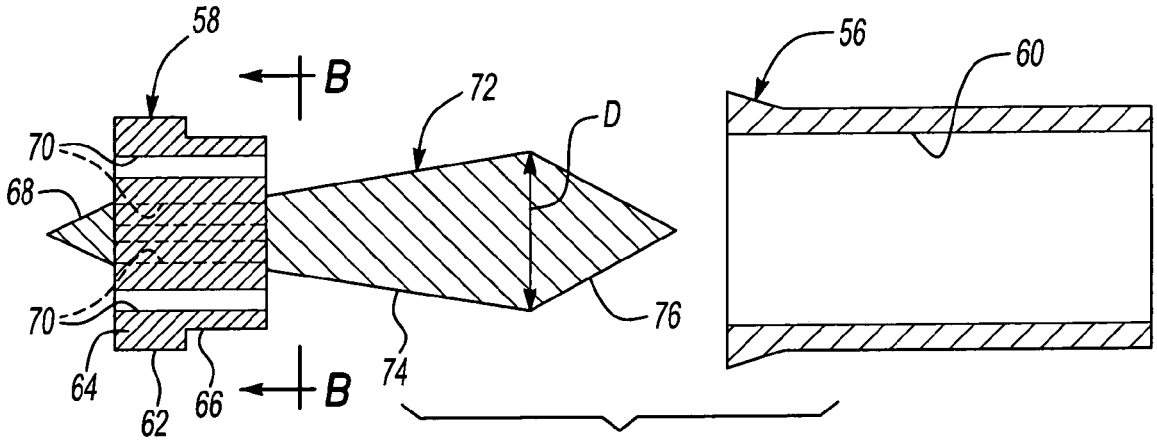
FIG. 3 is an exploded cross-sectional view of the supersonic portion of the nozzle.
Figure 4:
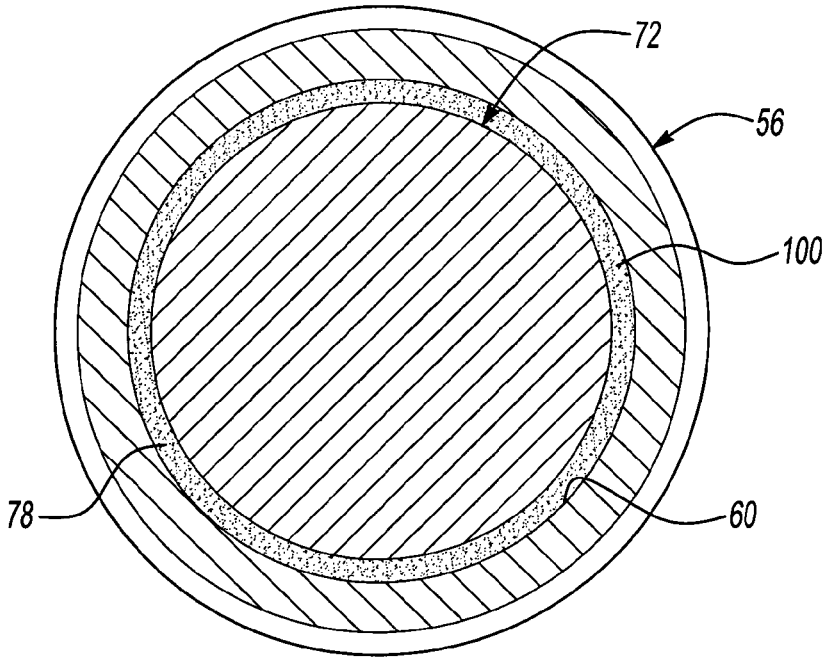
FIG. 4 is a cross-sectional view along line A-A of FIG. 2.
Figure 5:
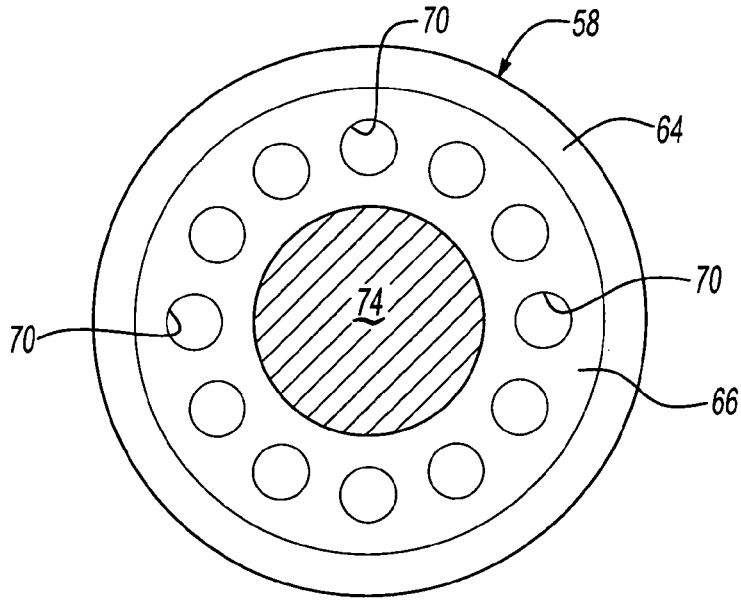
FIG. 5 is a cross-sectional view along line B-B of FIG. 3.
Figure 7:
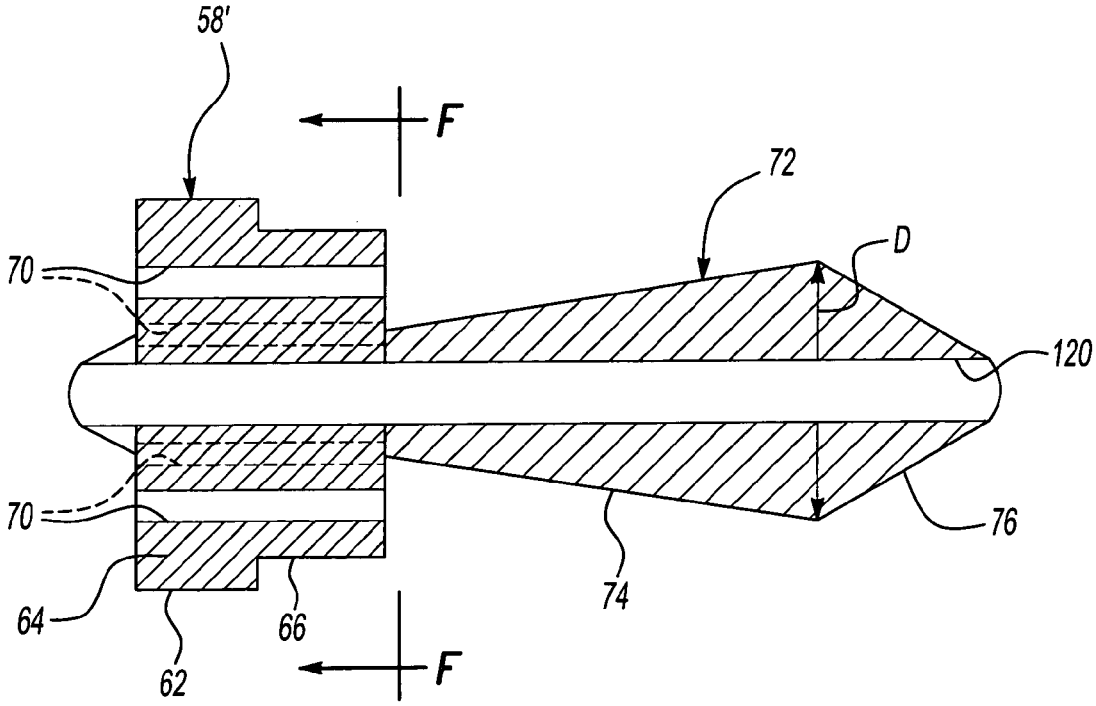
FIG. 7 is a cross-sectional view of another embodiment of a flow regulator designed in accordance with the present invention.
Figure 6:
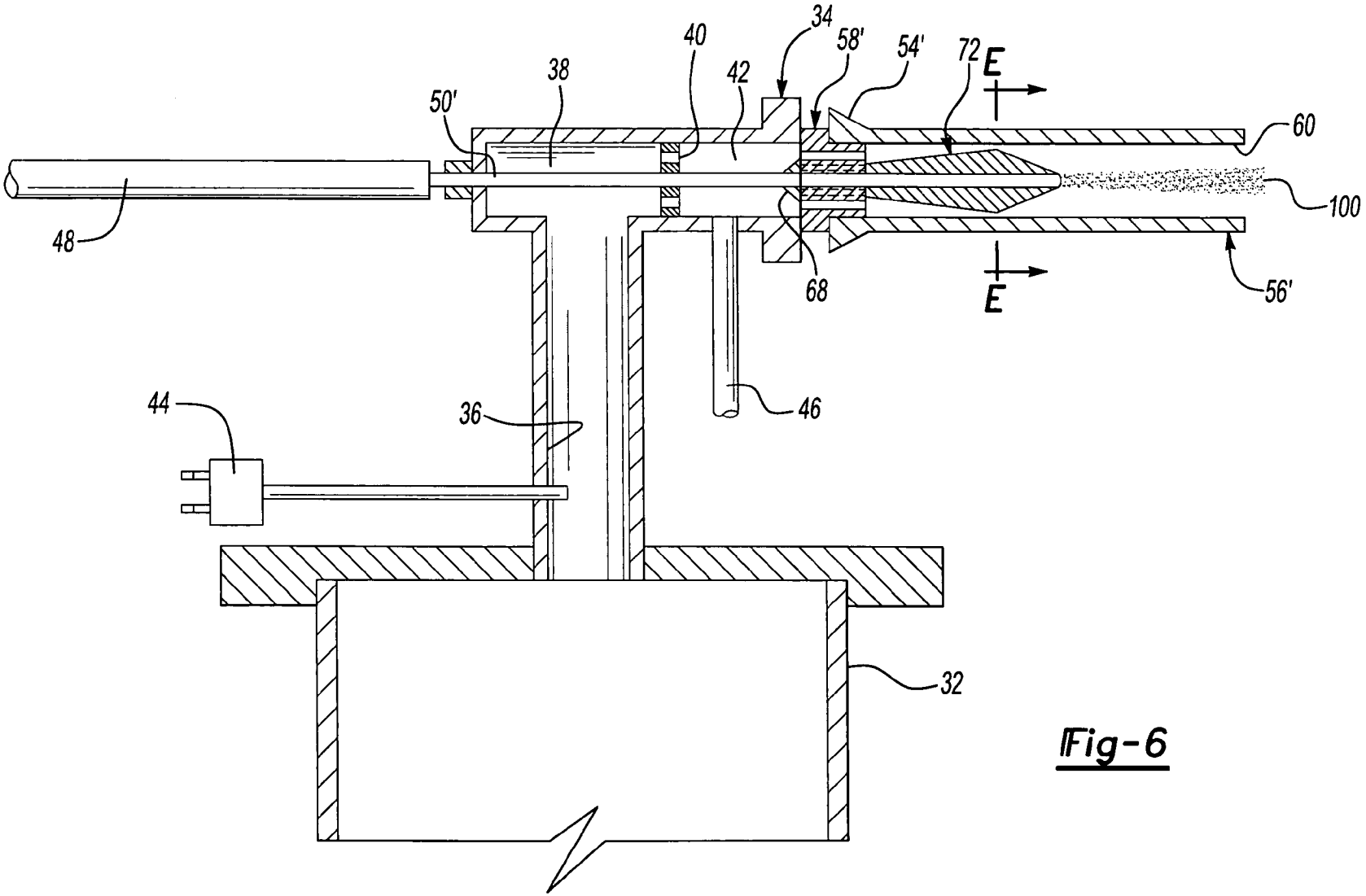
FIG. 6 is an enlarged cross-sectional view of another kinetic spray nozzle designed in accordance with the present invention and used in the system.
Figure 8:
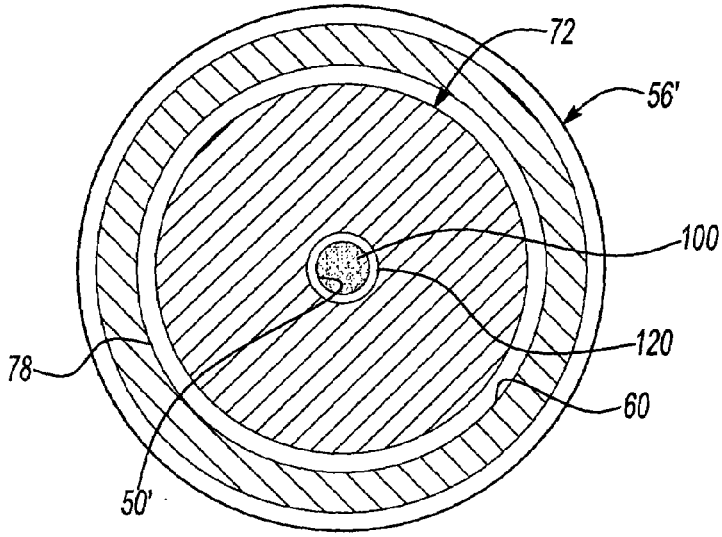
FIG. 8 is a cross-sectional view along line E-E of FIG. 6.
Figure 9:
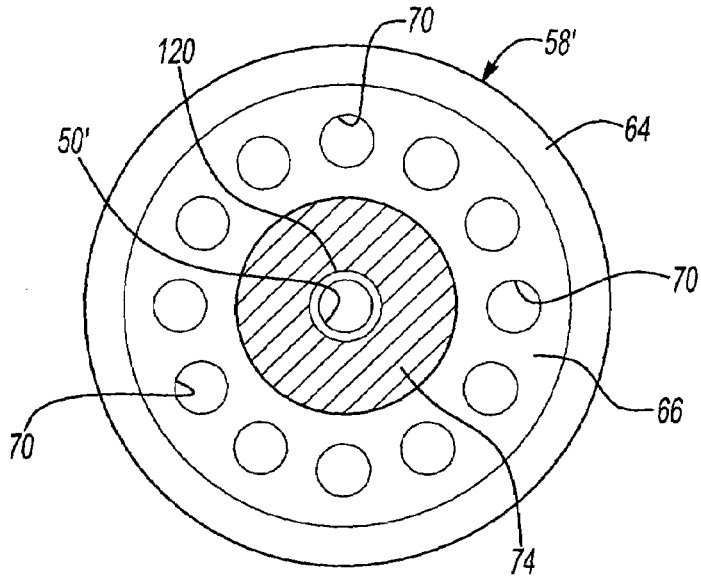
FIG. 9 is a cross-sectional view along line F-F of Figure.

Mixing chamber 42 is in communication with a supersonic nozzle 54 designed according to the present invention. Referring to FIGS. 2-5 the nozzle 54 has a tubular section 56 and a flow regulator 58. The tubular section 56 was an inner wall 60 with a diameter sufficiently large enough to receive a portion of the flow regulator 58 as is explained below. The tubular section 56 is shown in FIG. 3 as having a cylindrical inner and outer shape, however, the inner and outer shapes could be any shape as will be recognized by one of ordinary skill in the art. It is important that the shape of the inner wall 60 allow for an annular flow gap 78, as disclosed below.

The flow regulator 58 has a base portion 62 with a first half 64 opposite a second half 66. A first cone 68 projects from the first half 64. A plurality of holes 70 are spaced around the cone 68 and pass through the base portion 62. A flow concentrator 72 projects from the second half 66. The flow concentrator 72 is biconical with a second cone 74 and a third cone 76, the second and third cones 74, 76 sharing a common base diameter D. The diameter D is less than a diameter of the inner wall 60 at the point where they are adjacent to each other, as shown in the Figures. The second half 66 has a diameter that is less than a diameter of the first half 64.

The second half 66 and flow concentrator 72 are received in the tubular section 56 with the diameter of the second half 66 matching that of a diameter of the inner wall 60. The difference in the diameter D and the diameter of the inner wall 60 adjacent D defines an annular flow gap 78. Preferably, the flow gap is from 1 to 5 millimeters with from 2 to 3 especially preferred. Thus, the diameter of the inner wall 60 is from 2 to 10 millimeters greater than D and more preferably from 4 to 6 millimeters greater than D at the point where they are adjacent to each other.

In use of nozzle 54, the particles 100 are entrained in the main gas flow in the mixing chamber 42 the first cone 68 directs the entrained particles 100 and main gas through the holes 70 into the tubular portion 56. The second cone 74 forces the flow of gas and particles 100 outward toward the inner wall 60 and the gap 78. Once the flow and particles 100 reach the gap 78 the flow beyond the gap goes from sonic to supersonic. The shape of the third cone 76 and 60, permit the main gas flow to force the particles 100 to follow the contour of cone 76 and concentrates the particles 100 into a well defined small spot. The main gas largely flows outside the particle 100 stream and forces them into a compact flow. This enables one to create narrow width lines or spots in the absence of a mask. In fact, using the nozzle 54 of the present invention one can create spots having dimensions of 0.9 by 0.9 millimeters.

As discussed the powder injector tube 50 supplies a particle powder mixture to the system 10 under a pressure in excess of the pressure of the heated main gas from the passage 36. The nozzle 54 produces an exit velocity of the entrained particles 100 of from 200 meters per second to as high as 1200 meters per second. The entrained particles 100 gain kinetic and thermal energy during their flow through this nozzle 54. It will be recognized by those of skill in the art that the temperature of the particles 100 in the gas stream will vary depending on the size of the particles 100 and the main gas temperature. The main gas temperature is defined as the temperature of heated high-pressure gas at the inlet to the nozzle 54. The main gas temperatures are set so that the particles 100 are only heated to a temperature that is less than the melting point of the particles 100. This temperature can be substantially above the melting temperature of the particles 100. Temperatures can range from 200 to 1000 degrees Celsius. Because the particles 100 are exposed to these elevated temperatures for such a short period of time the particles 100 never reach their melting temperature. Thus, even upon impact, there is no change in the solid phase of the original particles 100 due to transfer of kinetic and thermal energy, and therefore no change in their original physical properties. The particles 100 are always at a temperature below the main gas temperature. The particles 100 exiting the nozzle 54 are directed toward a surface of a substrate to coat it.

Upon striking a substrate opposite the nozzle 54 the particles 100 flatten into a variety of nub-like structures with an aspect ratio of generally about 5 to 1. When the substrate is a metal and the particles 100 are a metal the particles 100 striking the substrate surface fracture the oxidation on the surface layer and subsequently form a direct metal-to-metal bond between the metal particle 100 and the metal substrate. Upon impact the kinetic sprayed particles 100 transfer substantially all of their kinetic and thermal energy to the substrate surface and stick if their yield stress has been exceeded. As discussed above, for a given particle 100 to adhere to a substrate it is necessary that it reach or exceed its critical velocity which is defined as the velocity where at it will adhere to a substrate when it strikes the substrate after exiting the nozzle 54. This critical velocity is dependent on the material composition of the particle 100 and the substrate. In general, harder materials must achieve a higher critical velocity before they adhere to a given substrate. It is not known at this time exactly what is the nature of the particle to substrate bond; however, it is believed that a portion of the bond is due to the particles 100 plastically deforming upon striking the substrate.

As disclosed in U.S. Pat. No. 6,139,913 the substrate material may be comprised of any of a wide variety of materials including a metal, an alloy, a semi-conductor, a ceramic, a plastic, and mixtures of these materials. All of these substrates can be coated by the process of the present invention. The particles used in the present invention may comprise any of the materials disclosed in U.S. Pat. Nos. 6,139,913 and 6,283,386 in addition to other know particles. These particles generally comprise metals, alloys, semiconductors, ceramics, polymers, diamonds and mixtures of these. In the present invention one can utilize particles 100 having a average nominal median diameter of from 1 to 200 microns, with 50 to 150 microns preferred and 50 to 125 microns especially preferred.

A second embodiment of a supersonic nozzle is shown generally at 54' in FIGS. 6-9. In this embodiment the tubular section 56' is elongated compared to nozzle 54. A powder injection tube 50' is elongated and extends through a flow regulator 58' to the tip of third cone 76. The elongated powder injector tube 50' is received inside a hole 120 in flow regulator 58'. Preferably, the powder is injected at a pressure of from 100 to 150 psi using this nozzle 54'. The other parameters described above for the first embodiment, nozzle 54, substrates, particles and main gas are equally useful for this embodiment. The other desirable modification is to elongate the tubular section 56' so it extends from 2.5 to 10 centimeters beyond the tip of third cone 76. The particles 100 are concentrated and focused by the main gas, which is supersonic after it passes through the gap 78 to produce a spot concentration of particles 100.

Figure 10:
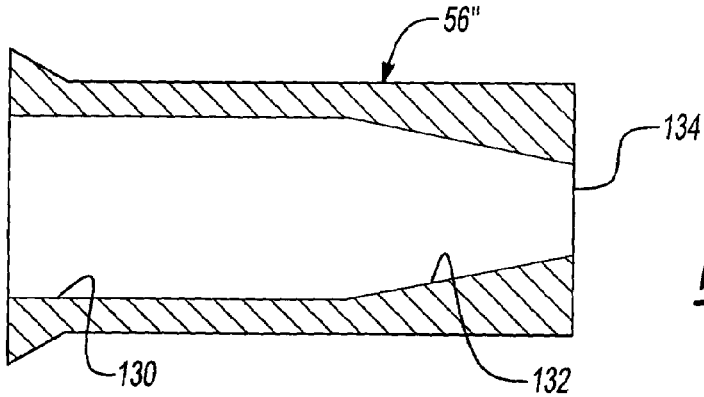
FIG. 10 is a cross-sectional view of another embodiment of a tubular section designed in accordance with the present invention.

In FIG. 10 another embodiment of a tubular section 56" is shown. In this embodiment the tubular section 56" includes a first portion 130 having a diameter sufficient to accommodate the flow regulator 58, 58' and to define the annular gap 78 between the first portion 130 and the flow regulator 58, 58' as described above. The tubular section 58" further includes a second portion 132 that has a tapered shape. The tapered shape receives the third cone 76 of the flow regulator 58, 58'. This second portion 132 ends in an exit end 134. The exit end 134 can have a variety of shapes including a rectangular shape, a circular shape, or a semi-circular shape. This tubular section 56" can function to further concentrate the flow of particles 100 as they exit from the nozzle 54, 54'.

The present invention permits one to create discrete spots on substrates and very narrow width lines. The spots have found use as electrical conductor points, wear points, and attachment points. The narrow width lines can be used to create electrical circuits and to coat very narrow width substrates.

While a preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

The invention claimed is:

1. Applying a coating by a kinetic spray method comprising the steps of:

a) providing a powder of particles to be sprayed;

b) providing a supersonic nozzle comprising an outer tubular section with an inner wall and a flow regulator with the flow regulator received inside the inner wall and a flow gap defined between the inner wall and the flow regulator;

c) providing a heated main gas and entraining the particles in the main gas;

d) directing the entrained particles through the gap thereby accelerating the particles and directing the accelerated particles toward a substrate positioned opposite the nozzle; and e) adhering the accelerated particles to the substrate to form a coating on the substrate.

2. The method as recited in claim 1, wherein step a) comprises providing particles having an average nominal median diameter of from 1 to 200 microns.

3. The method as recited in claim 1, wherein step a) comprises providing particles having an average nominal median diameter of from 50 to 150 microns.

4. The method as recited in claim 1, wherein step a) comprises providing particles having an average nominal median diameter of from 50 to 125 microns.

5. The method as recited in claim 1, wherein step a) comprises providing particles of a metal, an alloy, a semi-conductor, a ceramic, a polymer, diamond or mixtures thereof.

6. The method as recited in claim 1, wherein step b) comprises providing a flow regulator comprising a biconical flow concentrator formed from a second cone and a third cone sharing a common base with the flow gap defined by the space between the common base and the inner wall.

7. The method as recited in claim 1, wherein step b) comprises providing a flow gap of from 1 to 5 millimeters between the inner wall and the flow regulator.

8. The method as recited in claim 1, wherein step b) comprises providing a flow gap of from 2 to 3 millimeters between the inner wall and the flow regulator.

9. The method as recited in claim 1, further comprising providing a plurality of holes through a base portion of the flow regulator and passing the entrained particles through the plurality of holes prior to directing the entrained particles through the gap.

10. The method as recited in claim 1, wherein step c) comprises providing a heated main gas at a temperature of from 200 to 1000 degrees Celsius.

11. The method as recited in claim 1, wherein step d) comprises accelerating the particles to a velocity of from 200 to 1200 meters per second.

12. The method as recited in claim 1, wherein step e) comprises adhering the particles to a substrate comprising at least one of a metal, an alloy, a semi-conductor, a ceramic, a plastic, or a mixture thereof.

13. The method as recited in claim 1, wherein step e) comprises forming a coating having a width of less than or equal to 1 millimeter.

14. The method as recited in claim 1, wherein step e) comprises forming a coating having a width of less than or equal to 1 millimeter without using a mask or stencil.

15. The method as recited in claim 1, wherein step e) comprises forming a spot coating having a diameter of less than or equal to 1 millimeter.

16. The method as recited in claim 1, wherein step e) comprises forming a spot coating having a diameter of less than or equal to 1 millimeter without using a mask or stencil.

17. The method as recited in claim 1, wherein step b) further comprises providing a tubular section having a first portion and a second portion with the second portion having a tapered shape.

18. Applying a coating by a kinetic spray method comprising the steps of:

a) providing a powder of particles to be sprayed;

b) providing a supersonic nozzle comprising an outer tubular section with an inner wall and a flow regulator with the flow regulator received inside the inner wall and the flow regulator comprising a biconical flow concentrator formed from a second cone and a third cone sharing a common base and a flow gap defined by the space between the common base and the inner wall;

c) providing a heated main gas and passing the main gas through the gap;

d) entraining the particles in the main gas after it passes through the gap thereby accelerating the particles and directing the accelerated particles toward a substrate positioned opposite the nozzle; and e) adhering the accelerated particles to the substrate to form a coating on the substrate.

19. The method as recited in claim 18, wherein step a) comprises providing particles having an average nominal median diameter of from 1 to 200 microns.

20. The method as recited in claim 18, wherein step a) comprises providing particles having an average nominal median diameter of from 50 to 150 microns.

21. The method as recited in claim 18, wherein step a) comprises providing particles having an average nominal median diameter of from 50 to 125 microns.

22. The method as recited in claim 18, wherein step a) comprises providing particles of a metal, an alloy, a semi-conductor, a ceramic, a polymer, diamond or mixtures thereof.

23. The method as recited in claim 18, wherein the flow regulator further comprises a hole and the particles are passed through the hole prior to being entrained in the main gas.

24. The method as recited in claim 18, wherein step b) comprises providing a flow gap of from 1 to 5 millimeters between the inner wall and the flow regulator.

25. The method as recited in claim 18, wherein step b) comprises providing a flow gap of from 2 to 3 millimeters between the inner wall and the flow regulator.

26. The method as recited in claim 18, further comprising providing a plurality of holes through a base portion of the flow regulator and passing the main gas through the plurality of holes prior to passing it through the gap.

27. The method as recited in claim 18, wherein step c) comprises providing a heated main gas at a temperature of from 200 to 1000 degrees Celsius.

28. The method as recited in claim 18, wherein step d) comprises accelerating the particles to a velocity of from 200 to 1200 meters per second.

29. The method as recited in claim 18, wherein step e) comprises adhering the particles to a substrate comprising at least one of a metal, an alloy, a semi-conductor, a ceramic, a plastic, or a mixture thereof.

30. The method as recited in claim 18, wherein step e) comprises forming a coating having a width of less than or equal to 1 millimeter.

31. The method as recited in claim 18, wherein step e) comprises forming a coating having a width of less than or equal to 1 millimeter without using a mask or stencil.

32. The method as recited in claim 18, wherein step e) comprises forming a spot coating having a diameter of less than or equal to 1 millimeter.

33. The method as recited in claim 18, wherein step e) comprises forming a spot coating having a diameter of less than or equal to 1 millimeter without using a mask or stencil.

34. The method as recited in claim 18, wherein step b) further comprises providing a tubular section having a first portion and a second portion with the second portion having a tapered shape.

35. Applying a coating by a kinetic spray method comprising the steps of:

a) providing a powder of particles to be sprayed;

b) providing a supersonic nozzle comprising an outer tubular section with an inner wall and a flow regulator with the flow regulator received inside the inner wall and a flow gap defined between the inner wall and the flow regulator and with the flow regulator including a base portion defining a plurality of holes through the base portion;

c) providing a heated main gas and passing the main gas through the plurality of holes prior to passing the main gas through the gap and passing the main gas through the gap;

d) entraining the particles in the main gas after it passes through the gap thereby accelerating the particles and directing the accelerated particles toward a substrate positioned opposite the nozzle; and e) adhering the accelerated particles to the substrate to form a coating on the substrate.

* * * * *